United States Patent [19]

Block

[11] 4,379,662

[45] Apr. 12, 1983

[54] CONTROL DEVICE FOR AN ADVANCING SUPPORT IN UNDERGROUND MINING

[75] Inventor: Siegmar Block, Essen, Fed. Rep. of Germany

[73] Assignee: Thyssen Industrie AG, Fed. Rep. of Germany

[21] Appl. No.: 278,075

[22] Filed: Jun. 29, 1981

[30] Foreign Application Priority Data

Jun. 27, 1980 [DE] Fed. Rep. of Germany ..... 3024116

[51] Int. Cl.[3] ..... E21D 23/18

[52] U.S. Cl. ..... 405/302; 91/170 MP

[58] Field of Search ..... 405/291-302; 91/170 MP, 527, 529, 522, 530, 453; 299/32, 33

[56] References Cited

U.S. PATENT DOCUMENTS 3,453,935 7/1969 Rieschel ..... 405/299 X 3,541,926 11/1970 Grebe ..... 405/302 X 4,327,628 5/1982 Weirich et al. ..... 405/302 X

FOREIGN PATENT DOCUMENTS 1277786 9/1968 Fed. Rep. of Germany ..... 405/302

*Primary Examiner*—Dennis L. Taylor

*Attorney, Agent, or Firm*—McGlew and Tuttle

[57] ABSTRACT

An improved control for an underground mining working support unit arrangement of the type having an adjacent support unit arrangement hydraulically connectable to the working support unit arrangement in which a plurality of hydraulic supports support load points, it is disclosed wherein the hydraulic supports are successively connectable to several of the load points with a reversing valve operable to alternately connect control valves to selected hydraulic supports.

8 Claims, 1 Drawing Figure

CONTROL DEVICE FOR AN ADVANCING SUPPORT IN UNDERGROUND MINING

FIELD AND BACKGROUND OF THE INVENTION

This invention relates, in general, to control devices and, more particularly, to a new and useful control device for an underground mining advancing support unit arrangement, for example, of hydraulic props and the like for underpinning a mine rod, in which a hydraulic working medium is supplied to several load points, having control valves, a combination of hydraulic control conduits and fittings associated with each support unit which connect or transmit the loads to the control valves, the control conduits being of the type having a normal diameter which permits direct control of the loads.

For safety reasons, the loads accommodated by the hydraulic working medium are controlled as a rule from a neighboring or adjacent support unit arrangement. The individual control valves are associated with a control block and are connected over control lines or conduits with the loads in the working support. Since each individual load point is connected through a feed and return line to the control valves, and since each support unit arrangement accommodates a plurality of load points, the space requirement for the hose lines is quite considerable and represents not only a great material consumption, but hinders at the same time the descent and increases the risk of damage by falling rocks or improper driving of the support unit arrangements. In this type of laying the the control lines it is advisable if the loads can be controlled directly from the control valves, because of the hose lines with a great nominal diameter.

In order to reduce the space required by the control lines laid between the support unit arrangement, it has been suggested (see West German Offenlegunschrift No. 27 00 829) to use control lines having small diameters which are connected to a multiple hose line. Multiple hose lines used in a so-called pilot control, characteristically, are additionally protected by sheathing the multiple hose. A disadvantage however, is that pilot valves are required, in addition to the main valves, which complicates the control and leads to higher material and maintenance costs. Pilot valves are necessary because direct control over multiple lines with a small cross section is not possible.

Based on the finding that the individual loads have a different consumption of working medium, it has been suggested (see West German Auslegesschrift No. 28 07 431) to indirectly actuate the load portions with a relatively great media consumption per unit of time, from the adjacent support unit, that is, over control hoses with a small cross section and pilot valves, and to directly actuate the load points, with a low media consumption per unit of time, from the main control valve in the adjacent support unit arrangement.

However, the great number of pilot valves required is still a disadvantage resulting in increased material and maintenance costs.

SUMMARY OF THE INVENTION

An object of the invention is to provide a control device which permits the use of multiple hose lines, even with direct control, without additional requirements and expenditures for pilot valves and control lines.

The problem is solved, according to the invention, by providing an arrangement in which several load points can be successively connected to the control valves, of the adjacent support unit arrangement, by the same control lines over reversing valves associated with the working support unit arrangement.

The invention advantageously utilizes the fact that all load points of a support unit arrangement are not simultaneously supplied with the hydraulic working medium. The various control lines for different load points, therefore, can be used over the reversing valves so that the required number of control lines is considerably reduced.

Due to the greatly reduced need for control lines, it is possible to use multiple hose lines for direct control, even with the use of control lines with a greater nominal diameter, with the advantageous results of reduced space requirement and greater safety for the control lines. Particularly advantageous is the fact that sensitive pilot valves are not required anymore and, beyond that, the number of control valves can be reduced, since these can autoamtically be used for several loads.

Proper handling of the entire control device is ensured, since the reversing valves are actuated, according to the invention, from the control valve block of the adjacent support unit arrangement over a control valve. The control valve required for the reversing valves is thus integrated into the control system so that accessibility and handling safety are ensured.

In expedient embodiment of the invention, the control line for the reversing valves has the same nominal diameter as the control lines for the working valves and it is a part of the multiple hose line. Any commercial multiple hose line can be used that has individual pipes which can be randomly assigned to the individual control valves.

The sequence of operations in the support units is substantially the same and is repeated in a certain rhythm. In addition, there are load points which are admitted continuously with hydraulic working medium. A uniform balancing of the various control lines can be achieved with particular advantage if the load points to be actuated simultaneously are combined to group, as suggested by the invention, and are assigned to corresponding reversing valves. Furthermore, the reversing valves to expediently connect the load points having a high media consumption per unit of time with the control valves, since these are, as a rule, also the load points that are important for the operation of the support unit arrangement. This can be achieved in a particularly advantageous manner by designing the control actuating the reversing valves, according to the invention, as a self-closing valve. When the control valve is released, it immediately locks so that the load points with a high media consumption per unit of time are reconnected with the control lines over the reversing valves.

Adaptation to the local conditions, by increasing or changing the groups of load points to be actuated simultaneously, is readily possible since the control valves assigned to the control valve block are interchangeable, according to the invention. Since all control lines have the same nominal diameter, the number of control valves assigned to the load points, or the reversing valves or their position inside the control block can be readily changed.

The invention is particularly characterized by the elimination of control valves, sensitive pilot valves and hose lines, as well as by a reduced space requirement. In addition, the inventive arrangement can be adapted to the given local conditions without great costs.

Accordingly, it is a further object of the invention to provide an improved control device for an underground mining working support unit arrangement having hydraulic supports for supporting several load points, means for admitting a hydraulic working medium to the hydraulic supports, the admitting means including an adjacent support unit arrangement hydraulically connected to the working support unit arrangement, a control block having control valves and control conduits connected to the adjacent support unit arrangement for connecting the hydraulic supports for supporting the load points with the control valves, and each of the conduits having a nominal diameter which permits direct control of the hydraulic supports for supporting the load points, the improved control which is provided includes means for connecting the hydraulic supports for supporting the several load points excessively over the same control conduits to the control valves of the adjacent support unit arrangement, the connecting means includes reversing valves connected to the hydraulic support of the working unit arrangement and the conduits and over which the hydraulic supports for supporting the load points are connectable.

It is a further object of the invention to provide an improved control for an underground mining working support unit arrangement of the type having an adjacent support unit arrangement hydraulically connectable to the working support unit arrangement, a plurality of hydraulic supports composed of piston cylinder units having a cylinder with a bore and a piston member slidably mounted in the bore of the cylinder for displacement responsive to a hydraulic working medium admitted in first and second compartments in the cylinder on opposite sides of the piston member, means for admitting the hydraulic working medium to the bore, the admitting means having control conduits connected to each of the compartments of each piston cylinder unit and control valve means interposed in the conduits for controlling the admission of the hydraulic working medium, the admitting means being hydraulically connected to the adjacent support unit arrangement, the hydraulic support supporting a plurality of load points, and each of the conduits having nominal diameter which permits the direct control of the hydraulic supports, the improvement, which is provided, comprises means for successively connecting selective hydraulic supports for supporting several of the load points to the control valve means, and the connecting means including at least one reversing valve operable to alternately connect control valves to selected hydraulic supports.

It is a further object of the invention to provide an improved control for an underground mining working support unit arrangement which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DETAILED DESCRIPTION

Figure 1:
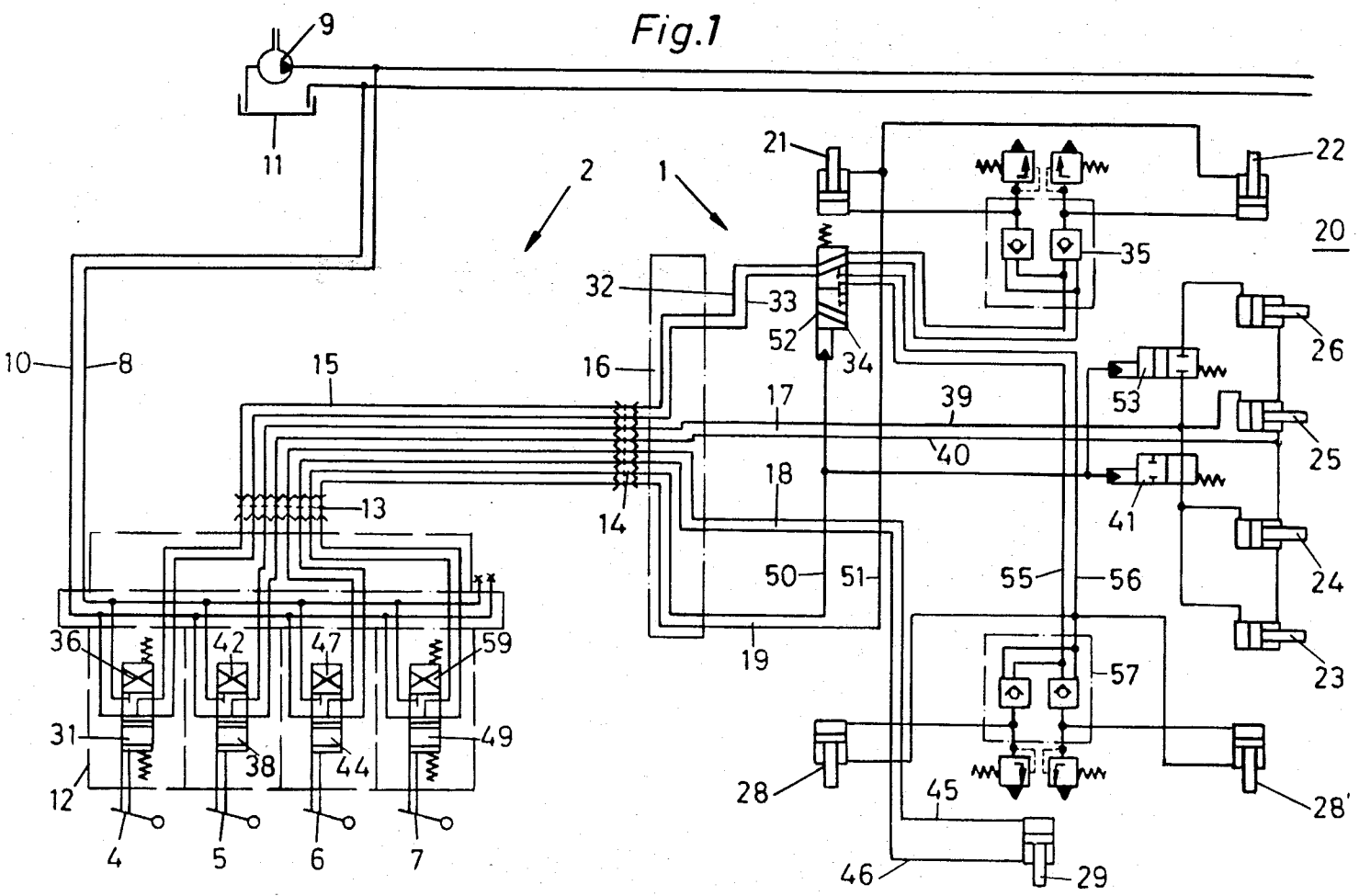
FIG. 1 illustrates a schematic hydraulic transmission diagram of a control device according to the invention.

Portions of a working support unit arrangement 1 and an adjacent support unit arrangement 2 are indicated in the drawing by the separate reference numbers to clarify which parts of the control device are assigned to one or the other support unit arrangement. Each support unit arrangement 1 or 2 receives again from the adjacent support unit corresponding to the other part of the control device. The illustrated control device is intended for mine shield units, but can also be readily used for shoring or blocks with some modifications.

The adjacent support unit arrangement 2 has the so-called adjacent control with control valves 4,5,6,7. The control valves 4,5,6,7 are connected jointly over a hydraulic conduit or line 8 with a pump 9, and over hydraulic conduit or line 10 with a reservoir of a hydraulic working medium in a tank 11. The control valves 4,5,6,7 are mounted in a control valve block 12.

A multiple hose line 15, including control line pairs 16,17,18, 19 serves to connect valves 4,5,6,7 to the load points. The multiple hose line has, at both ends, a special fitting or coupling 13,14, over which a quick connection and disconnection are ensured for the assembly and for repairs.

At the receiving end 20 of the working support arrangement 2, in the represented embodiment, there is found props 21,22, line cylinders 23,24,25,26 and corner cylinders 28,28' as well as an advancing cylinder 29 which, as illustrated, are normally designed in the form of piston cylinder units having a cylinder with a bore and piston member slidably mounted in the bore of the cylinder for displacement responsive to a hydraulic working medium admitted in first and second compartments in the cylinder on opposite sides of the piston member.

In the normal operating position, props 21,22 are controlled by control valve 4. When the operating lever of control valve 4 is actuated and a first switching position 31 is set, the pistons of props 21,22 are extended by pressurization over a line 32, a reversing valve 34, and a clearing and setting valve 35. By switching the control valve 4 into a second switching position 36, and reversing valve 34 over line 33, clearing and setting valve 35 is unlocked so that the pistons of props 21,22 are relieved to the reservoir of tank 11 over line 32 and control valve 4.

When control valve 5 is switched into a switching position 38, the piston of line cylinder 25 is extended directly, over line 39, and line cylinders 23 and 24 over an open reversing valve 41. In a switching position 42 of control valve 5, the pistons of line cylinders 23,24 and 25 are retracted over line 40.

Through control valve 6, the piston of advancing cylinder 29 is extended in switching position 44 over a line 45, and in a switching position 47, it is retracted again over line 46.

The above described control functions are selected directly over control valves 4,5,6. When control valve 7 is brought into switching position 49, reversing valve 34 is brought into switching position 52, reversing valve 41 into closing position and reversing valve 53 into transient position. By actuating reversing valves 34,41,53, control line pairs 16,17 which have been used heretofore for props 21,22 and line cylinders 23,24, are now used for corner cylinders 28,28' and line cylinders 25,26. When control valve 4 is brought into the second switching position 36, the pistons of corner cylinders 28,28' are extended over line 33, reversing valve 34, line 45 and valve 57. When switching position 31 is selected, reversing valve 34 is unlocked over line 32 and valve 57 over line 56, and at the same time the ring surface of corner cylinders 28,28' is admitted so that the pistons of the latter retract.

The pistons of line cylinders 25,26 are extended by bringing control valve 5 into switching position 42, so that hydraulic working medium is conducted over line 39 and the open shut-off valve 53 to line cylinders 25,26. In switching position 38, line cylinder 25,26 retract again via line 40.

In the represented embodiment, control valve 6, and thus also control line pair 18 are not double-occupied. Rather advancing cylinder 29 is supplied continuously with hydraulic working medium over this line and the control position.

If switching position 59 of valve 7 is selected during the clearance of the pistons of the props 21,22, the latter are retracted over line 51.

Control valve 7, just like control valve 6, is designed as a self-closing valve, that is, as a deadmans valve. When the operating lever of control valve 7 is released, reversing valves 34,41,53 therefore move back automatically into their normal position, so that direct control with control valves 4,5,6 is possible again. Control line pairs 16,17 are thus switched again to props 21,22 and line cylinders 23,24,25 respectively, while control line pair 18 is still being switched to advancing cylinder 29. Control line pair 19 is reserved exclusively for control valve 7 and reversing valves 34,41,53.

Thus, in accordance with the invention, a control device is provided for a support unit arrangement having several load points that can be admitted with a hydraulic working medium in underground mining with control valves and control lines associated with the adjacent support unit arrangement, which connects the load points with the control valves and whose nominal diameter permits direct control of the load points, characterized in that several load points have hydraulic supports 21,22,23,24,25,28,29 can be connected successively over the same control lines 16,17 to the control valves 4,5 arranged in the adjacent support unit arrangement 2 over reversing valves 34,41,53 associated with the working support unit arrangement 1. The inventive arrangement is preferably characterized in that the reversing valves 34,41,53 are actuated from the control valve block 12 on the adjacent support unit arrangement 2 over a control valve 7.

In accordance with a preferred embodiment, the inventive arrangement is further characterized in that the control line 19 for the reversing valves 34,41,53 has the same nominal diameter as the control lines 16,17,18 for the working valves 36,57 and is a part of the multiple hose line 15.

The load point hydraulic supports 21,22,23,24,25,26,28,29 are preferably combined into groups which are to be actuated simultaneously and are assigned to corresponding reversing valves 34,41,53. The reversing valves 34,41,53 preferably connect the load point hydraulic supports 21,22,23,24,25,29, having a large media consumption per unit of time, with the control valves 4,5,6.

The control valve 7, actuating the reversing valves 34,41,53 is preferably designed as a self-closing valve, and the control valves 4,5,6,7 associated with the control block 12 are interchangeable.

While a specific embodiment of the invention has been shown and described in detail to illustrate the application of the principles of the invention, it will be understood that the invention may be embodied otherwise without departing from such principles.

What is claimed is:

1. An improved control device for an underground mining working support unit arrangement having hydraulic supports for supporting several load points, means for admitting a hydraulic working medium to the hydraulic supports, the admitting means including an adjacent support unit arrangement hydraulically connected to a working support unit arrangement, a control block having control valves and control conduits connected to the adjacent support unit arrangement for connecting the hydraulic supports for supporting the load points with the control valves, and each of the conduits having a nominal diameter which permits direct control of the hydraulic supports for supporting the control points, the improved control which comprises means for connecting the hydraulic supports for supporting several load points successively over the same control conduits to the control valves of the adjacent support unit arrangement, said connecting means including reversing valves connected to the hydraulic supports of the working unit support arrangement and the conduits and over which the hydraulic supports for supporting the load points are connectable.

2. An improved control device according to claim 1, wherein the control valves includes an adjusting control valve on the adjacent support unit arrangement for actuating said reversing valves from the control valve block over said adjusting control valve.

3. An improved control device according to claim 1, or claim 2, wherein the conduits include a control line connecting said reversing valves to the control valves, the control line having the same nominal diameter as the control conduits, and wherein the conduits comprise a multiple hose line.

4. An improved control device according to claim 1, wherein said reversing valves are connectable to a selected group of the hydraulic supports for supporting the load points and are simultaneously actuable.

5. An improved control device according to claim 1, wherein said reversing valves connect the hydraulic supports supporting the load points which have a large media consumption per unit of time with the control valves.

6. An improved control device according to claim 2, wherein said adjusting control valve is a self closing valve.

7. An improved control device according to claim 2, wherein the control valves associated with the control block are interchangeable.

8. An improved control for an underground mining working support unit arrangement of the type having an adjacent support and arrangement hydraulically connectable to the working support unit arrangement, a plurality of hydraulic supports composed of piston-cylinder units having a cylinder with a bore and a piston member slidably mounted in the bore of the cylinder for displacement responsive to a hydraulic working medium admitted in first and second compartments in the cylinder on opposite sides of the piston member, means for admitting the hydraulic working medium to the bore, the admitting means having control conduits connected to each of the compartments of each piston-cylinder unit and control valve means interposed in the conduits for controlling the admission of the hydraulic working medium, the admitting means being hydraulically connected to the adjacent support unit arrangement, the hydraulic supports supporting a plurality of load points, and each of the conduits having a nominal diameter which permits direct control of the hydraulic supports, the improvement comprising means for successively connecting selective hydraulic supports for supporting several of the load points to the control valve means, and said connecting means including at least one reversing valve operable to alternately connect control valves to selected hydraulic supports.

* * * * *